United States Patent [19]

Szarka

[11] Patent Number: 5,022,320

[45] Date of Patent: Jun. 11, 1991

[54] ADJUSTABLE PARALLEL MOTION LINKAGE SYSTEM FOR SCREEN PRINTER

[75] Inventor: Sandor Szarka, Franklin Lks., N.J.

[73] Assignee: Precision Screen Machines, Inc., Hawthorne, N.J.

[21] Appl. No.: 351,579

[22] Filed: May 15, 1989

[51] Int. Cl.[5] ..... B41F 15/08; B41F 15/14

[52] U.S. Cl. ..... 101/123; 101/127.1

[58] Field of Search ..... 101/123, 124, 126, 127.1

[56] References Cited

U.S. PATENT DOCUMENTS

| | | | |
|---|---|---|---|
| 3,370,569 | 2/1968 | Runge | 101/123 X |
| 3,638,564 | 2/1972 | Prange et al. | 101/126 X |
| 4,068,579 | 1/1978 | Poo et al. | 101/124 X |

*Primary Examiner*—Clifford D. Crowder

*Attorney, Agent, or Firm*—Hopgood, Calimafde, Kalil, Blaustein & Judlowe

[57] ABSTRACT

Apparatus for off-contact screen printing in which the distance between the screen and the article to be printing upon is quickly and easily adjusted by a saingle manipulation of a lever. Advantageously, this screen adjustment is performed so that the screen remains parallel to the article and does not need to be leveled each time an adjustment is made. The apparatus includes a linkage system for holding the screen level as the screen moves up and down during the screen printing operation.

9 Claims, 5 Drawing Sheets

ADJUSTABLE PARALLEL MOTION LINKAGE SYSTEM FOR SCREEN PRINTER

BACKGROUND OF THE INVENTION

The present invention relates to screen printing machines, and more particularly to an improved apparatus for off-contact screen printing.

The printing of images on articles, and particularly clothing (such as T-shirts and the like), is commonly accomplished using screen printing machines. Generally, these machines are provided with a print squeegee which is stroked across the surface of the screen so as to force printing ink through the screen thereby effecting printing. A screen printing apparatus of this general configuration is disclosed, for example, in U.S. Pat. No. 3,795,189, and in a copending U.S. Pat. No. 4,939,991, disclosures of which are hereby incorporated by reference. In operation, the clothing or other material to receive the print image are placed on pallets so that the surface to be printed upon is exposed. The pallets are then indexed to individual print stations where a printing head lowers the printing screen to position slightly above the print surface. Subsequently, flood and squeegee blades are stroked across the screen to print an image on the print surface. As the squeegee blade passes over the screen, it momentarily forces the screen to contact the printing surface while at the same time forcing ink through the screen to effect printing. Once the squeegee has passed a point along the screen, that portion of the screen lifts off the article as a result of the elasticity of the stretched screen material, thus giving rise to the term "off contact printing".

As would be understood by one skilled in the art, the distance between the screen and the printing surface is critical to the quality of the print image. This distance varies depending on the thickness of the article to be printed upon, the particular printing effect desired, and the characteristics of the screen and ink. In addition to utilizing the appropriate distance between the screen and printing surface, it is important that the screen be parallel to the surface to be printed upon so as to avoid uneven, faint or smudged print images.

In the past, the distance between the screen relative to the print surface during printing has been accomplished using a plurality of screw-type elements located at the four corners of the screen frame. Although this arrangement allowed for the accurate positioning of the screen, it was tedious and time-consuming, particularly in view of the need to keep the screen level. Moreover, it has been found that these screw-type adjustments tend to loosen under the constant vibration associated with the operation of the printing machine.

SUMMARY OF THE INVENTION

In accordance with one aspect of the present invention, there is provided a printing head assembly for application to a screen printing machine which includes a parallel motion linkage for the uniform and positive positioning of a printing screen frame. In use, a single control lever associated with the parallel motion linkage effects the positioning of the screen at a selected distance from the printing surface during the printing operation. Although the present invention is disclosed and shown herein in conjunction with the printing of pallet-supported articles, e.g. clothes, it may be adapted for printing on other objects such as glass, wood, paper, vinyl or metal sheets and panels. The article to be printed upon may be supported or carried by a printing belt.

The present invention is directed to a printing head assembly for a screen printing machine comprising:

- a frame;
- a carriage assembly attached to and supported by said frame; and
- a parallel motion linkage attached to said frame and adapted to hold a framed screen unit, said parallel motion linkage comprising an adjustment means for the parallel adjustment of the position of the screen unit by a single manipulation.

The present invention is further directed to an apparatus adapted for accurately positioning a screen in a screen printing head assembly relative to a print image, comprising:

- a parallel motion means, suspended from the frame of said screen printing head assembly, for holding a framed screen unit above and parallel to an article to be printed upon and for vertically translating said screen between a raised position and a lowered position; and
- an adjustment means, engaging said parallel motion means, for adjusting the distance between said screen and said article by a single manipulation which simultaneously shifts the vertical location of said raised and lowered positions while keepinq said screen level.

Accordingly, it is an object of the present invention to provide an assembly which facilitates improved off-contact printing by permitting the adjustment of the distance between the printing screen and the print surface quickly and efficiently.

Another object of the present invention is to provide an assembly which enables the precise leveling of a printing screen relative to the printing surface thereby improving the quality of print image.

The present invention will now be further described by reference to the following drawings which are not to be deemed limitative in any manner thereof.

BRIEF DESCRIPTION OF THE DRAWINGS

The same numerals are used throughout the various figures of the drawings to designate similar parts.

Still other objects and advantages of the present invention will become apparent from the following description of the preferred embodiments.

DETAILED DESCRIPTION OF THE PREFERRED EMBODIMENTS

Figure 1:
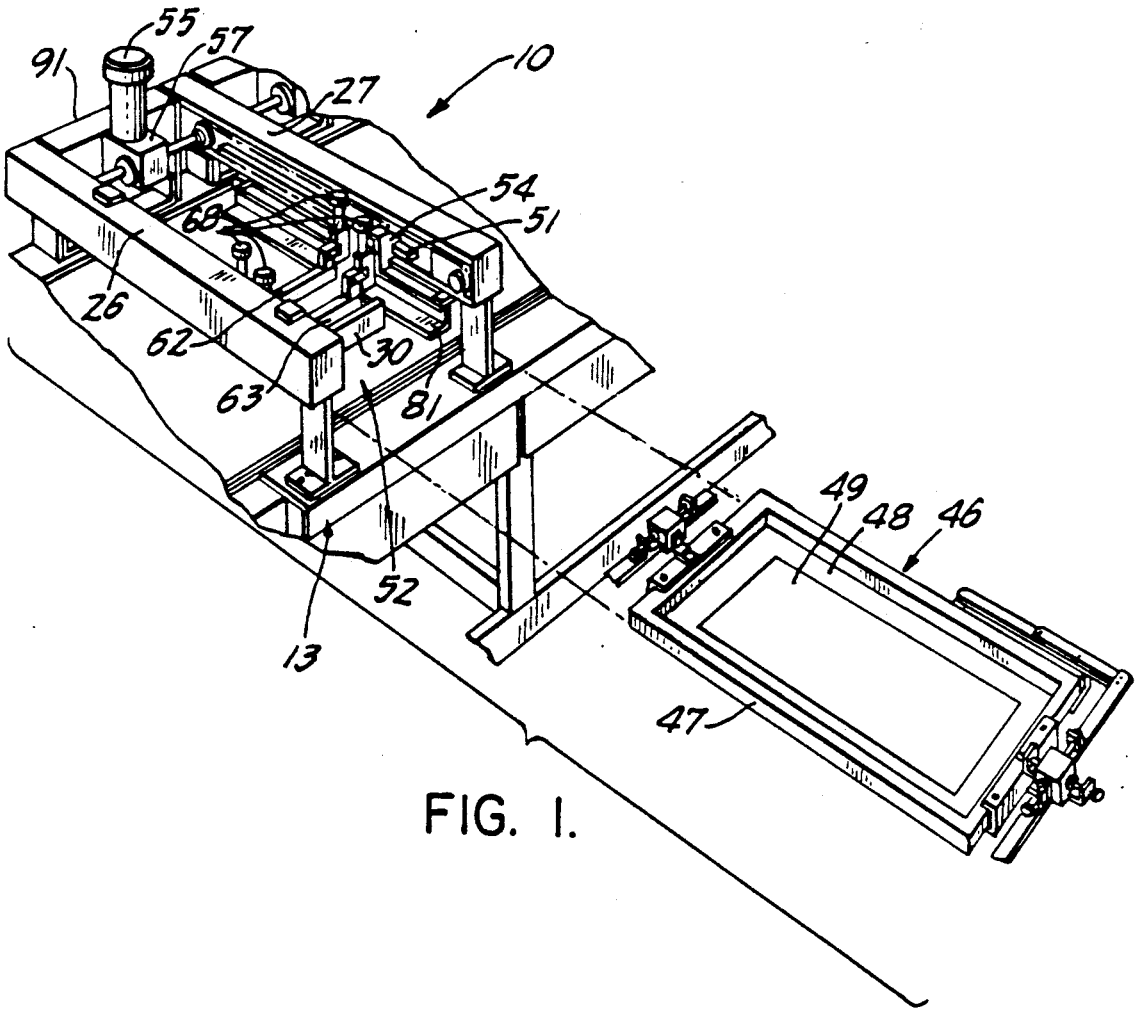
FIG. 1 is a perspective view of a printing head assembly embodying the present invention.
Figure 2:
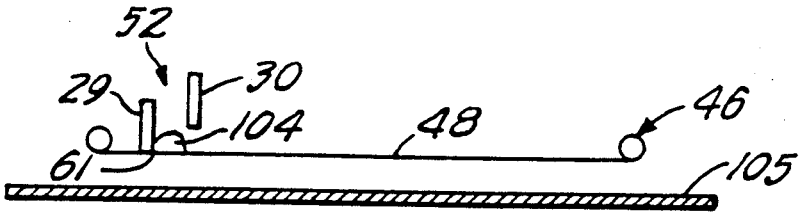
FIG. 2 to 8 are diagrammatic views illustrating the operating sequence of the printing head assembly of FIG. 1.

FIG. 1 illustrates a printing head assembly 10 adapted for use in conjunction with a screen printing machine 13. The printing head assembly 10 includes a carriage assembly 52 adapted to hold a framed screen unit 46.

Screen unit 46 includes frame 47 and screen 48, having a pattern 49 embossed thereon.

Figure 3:
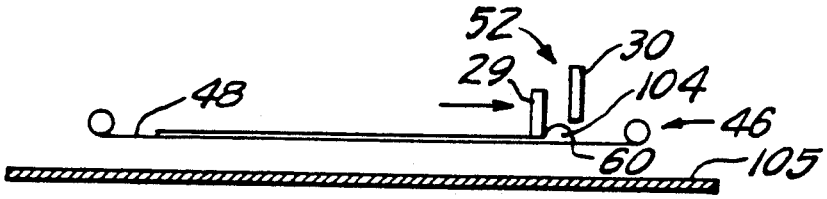
Figure 4:
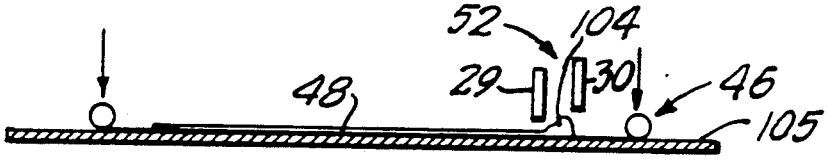
Figure 5:
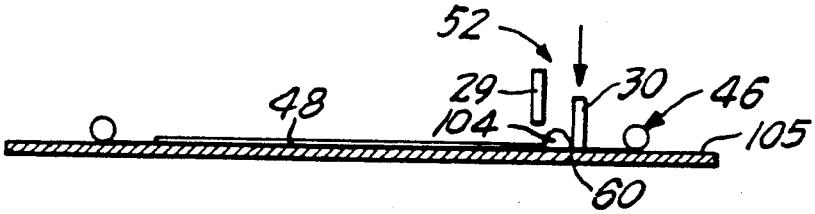
Figure 6:
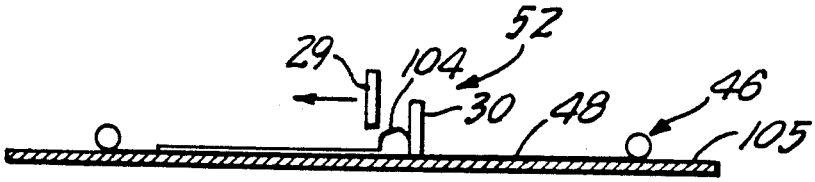
Figure 7:
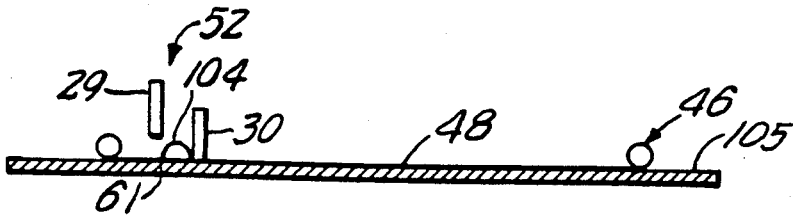
Figure 8:
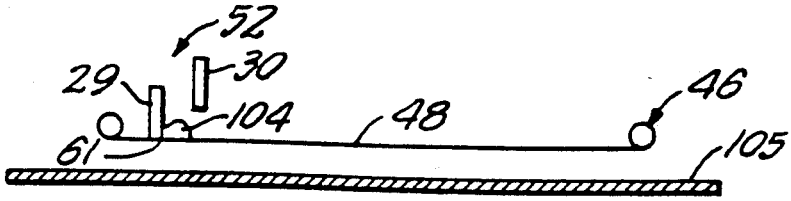

FIGS. 2–8 illustrate a printing operation sequence. Specifically in FIG. 2 with screen 48 elevated above article 105, a quantity of ink 104 is pushed across the screen by flood bar 29 (FIG. 3). When flood bar 29 reaches its terminal position 60, screen 48 is lowered to a position in close proximity to the surface of article 105 to be printed upon (FIG. 4). Flood bar 29 is raised, and squeegee blade 30 lowered to screen 48 (FIG. 5). Subsequently, blade 30 begins its print stroke across the screen, deflecting screen 48 against the print surface while simultaneously forcing ink 104 through the screen onto article 105 to form a print image (FIGS. 6–7). The framed screen mount 46 then lifts away from the article 105, completing the cycle (FIG. 8).

Figure 9:
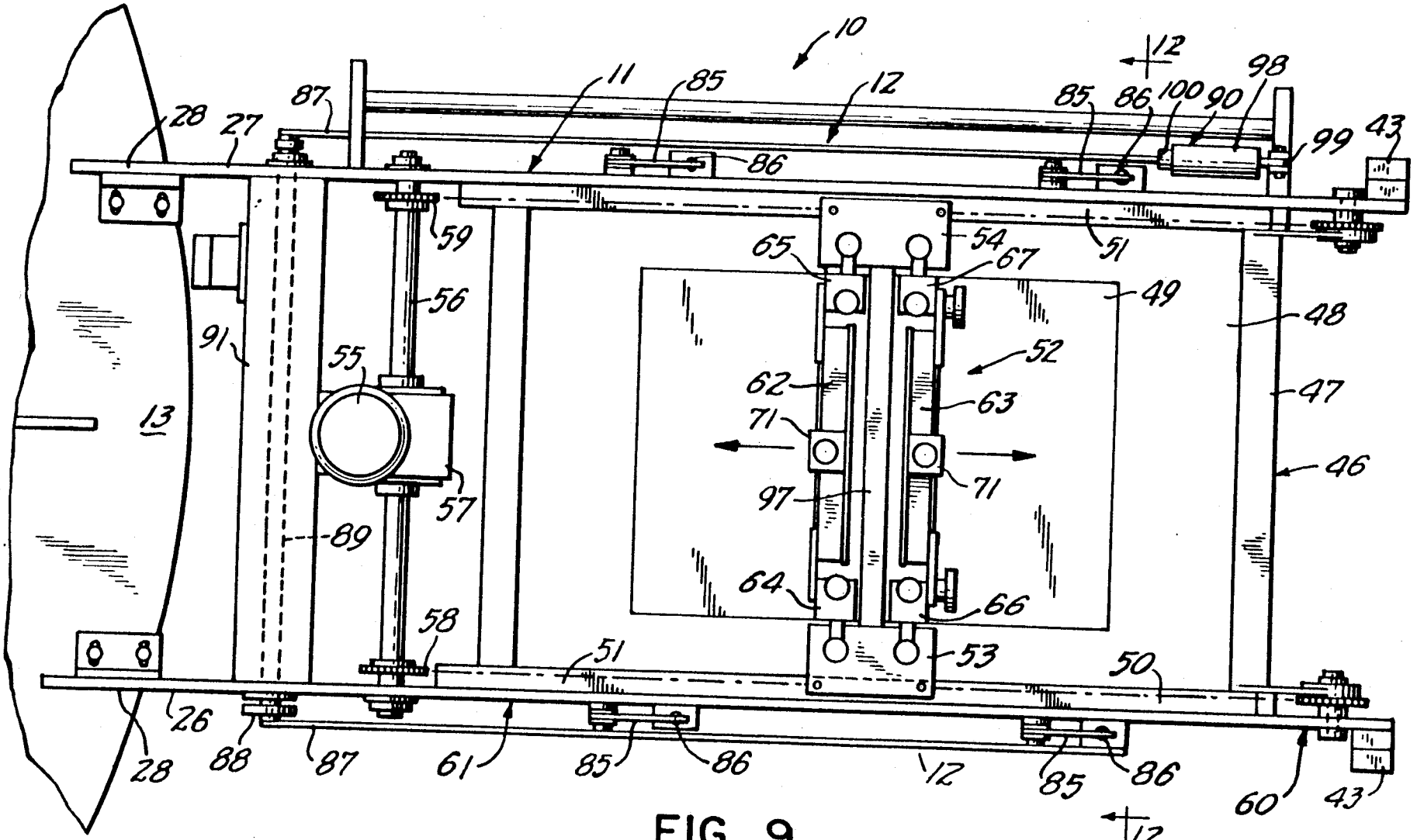
FIG. 9 is a partial top plan view of the printing head assembly of FIG. 1.

Referring to FIG. 9, print head frame 11 comprises parallel frame members 26 and 27, to which a pair of parallel horizontally disposed spaced apart rails 50 and 51 are joined. As shown, frame members 26 and 27 are joined at their end portions to the base frame of the printing apparatus 13, and are stabilized by tie bar 91.

Rails 50 and 51 mount carriage assembly 5 therebetween by means of chopper blocks 53 and 54 located at opposite ends of the carriage assembly. Chopper blocks 53 and 5 are provided with recessed portions along the cross section thereof having selected dimensions which permit cooperation with rails 50 and 51, respectively, so that the chopper blocks and the associated carriage assembly 52 may move along the rails. A motive device, e.g., a conventional A.C. electric motor 55 drives a shaft 56 through a gear train assembly 57. Shaft 56 connects with sprocket and chain loops 58 and 59 linked to the chopper blockers 53 and 54 for selectively transporting the carriage assembly 52 along the rails between terminal points 60 and 61.

Carriage assembly 52 also includes mounts 62 and 63, for flood bar 29 and squeegee blade 30 respectively. As can best be seen in FIG. 9 mounts 62 and 63 are movably mounted between chopper blocks 53 and 54 for vertical movement relative thereto via vertical slides 64, 65, 66 and 67, mounted in corresponding keyhole shaped vertical slot in their respective chopper blocks.

Figure 10:
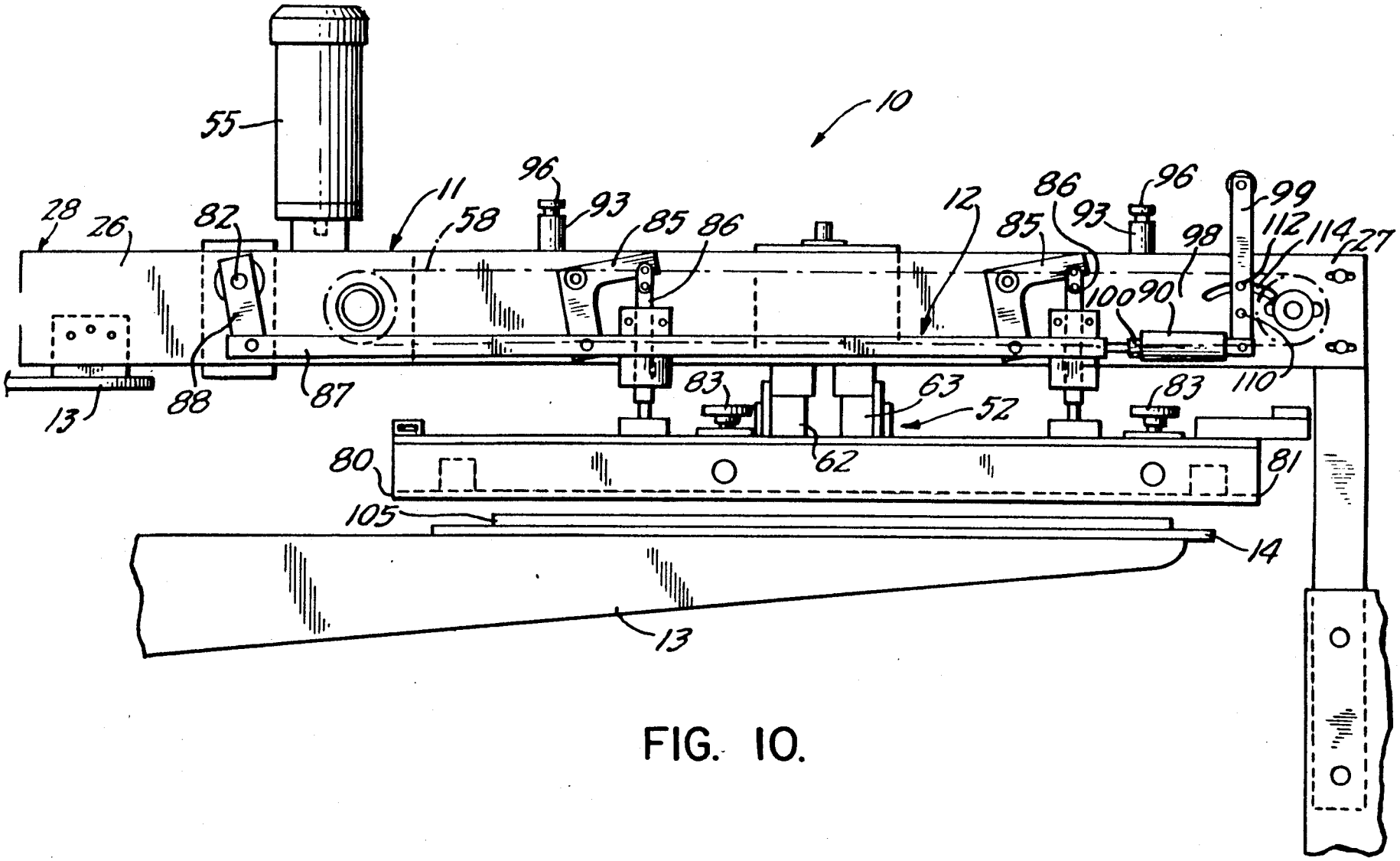
FIG. 10 is a side view of the printing head assembly of FIG. 9.
Figure 11:
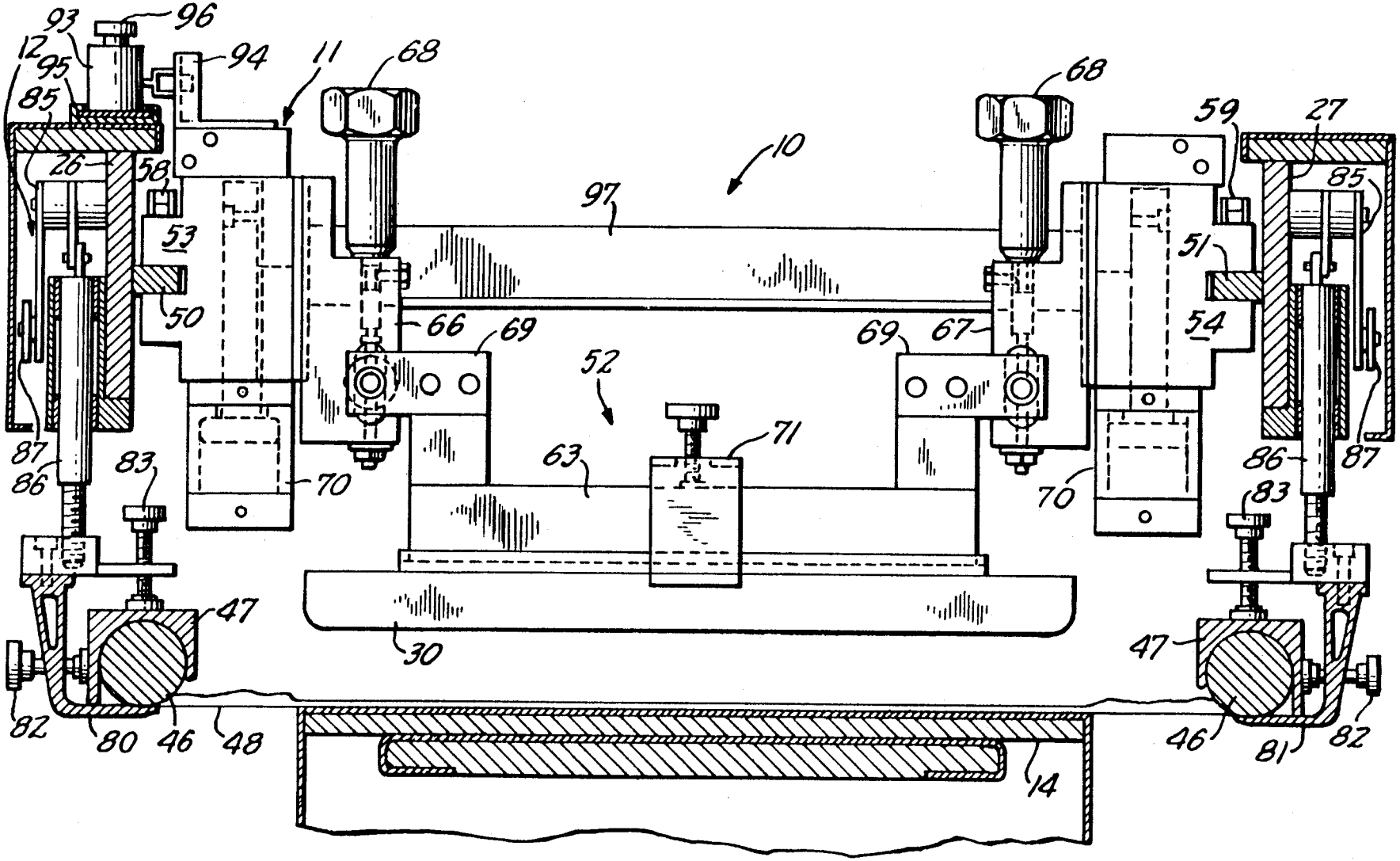
FIG. 11 is a section view of FIG. 9 taken along line 12—12 of FIG. 9, with the squeegee in the raised position.

Referring to FIG. 11, a pair of parallel members in the form of flanges 80 and 81 are provided for receiving the frame-mounted printing screen 48. A parallel motion linkage 12, as shown in FIGS. 9 and 10, is used to suspend flanges 80 and 81 from the printing head frame assembly 10 for selectably raising and lowering the framed screen unit 46 parallel to the plane of the printing surface.

The parallel motion linkage 12 comprises a plurality of bell cranks 85 linked to the flanges 80 and 81 via rods or links 86, and an operating bar 87 on each side of the head frame 10, each bar 87 rotatably connected to bell cranks 85 disposed on the same side of the head frame 10. The operating bars 87 are connected at one end to crank arms 88 which are attached to opposite ends of a rotatable shaft 89.

When one operating bar 87 moves horizontally, the associated crank arm 88 is caused to rotate the shaft 89; this rotation in turn moves the opposite crank arm 88 so that the opposite bar 87 will move horizontally to match the movement of the first bar 87. The horizontal movement of the bars 87 causes movement of the bell cranks 85. This arrangement insures that all the bell cranks 85 will move in tandem, raising or lowering the flanges 80 and 81 in unison, thus keeping the screen 48 level. One bar 87, at the end remote from the shaft 89, is connected to actuator means in the form of an actuator 90 which drives the bar 87 horizontally back and forth to cause the vertical translation of the flanges 80 and 81 and the screen 48.

This actuator 90 is of known construction and comprises an outer cylinder housing 98 and associated piston rod 100. The piston rod 100 has a predetermined stroke relative to the oylinder 98, movinq between a non-extended position and an extended position. When the rod 100 is extended the screen 48 is moved into its lowered position so that printing may occur. When the rod 100 retracts the screen 48 is moved into a raised position.

As best seen in FIG. 10, the end of the cylinder 98 remote from the bar 87 is pivotally connected to a lever 99. This lever 99 is pivotally connected to the beam 27 at a pivot point 110. When the lever 99 is pivotted, the actuator 90 is displaced horizontally, altering the height of the screen 48 in both its raised and lowered positions. Thus, by this adjustment means the height of the screen 48 above a pallet-supported article 105 may be adjusted as desired. The lever 99 is locked into the desired position by a locking means comprising a slot 114 in the beam 27 and a finger guide 112, extending from the lever 99, cooperating with the slot 114. In a preferred embodiment, the guide 112 comprises a threaded screw which is inserted through the slot 114 and screwed into the lever 99 so that the screwhead is located on the side of the beam 27 opposite the lever 99; when the screw is tightened the screwhead, which is wider than the slot width, presses against the beam 27 while the lever 99 is drawn against the other side of the beam 27. The lever 99 advantageously comprises a threaded hole to receive the screw; a lock washer and a regular washer may be employed on the threaded end of the screw. The head of the screw may be adapted to be hand tightened and loosened, or adapted to receive a screwdriver.

Referring to FIG. 11, when a screen 48 is mounted onto flanges 80 and 81, adjustment means in the form of horizontal thumbscrews 82 are manipulated to align screen 48 over pallet 14, and vertical thumbscrews 83 are then used to lock the screen into place. Lever 99 is then manipulated to move the linkage 12 to initially adjust the distance between screen 48 and pallet 14 while keeping the screen 48 level and parallel relative to the pallet 14. Once lever 99 is properly positioned, the screw 112 is tightened to prevent further movement of lever 99.

If at any time during the printing operation it is desired to change the position of the screen relative to the print surface, it is only necessary for the operator to adjust lever 99 to a new position by loosening screw 112, moving lever 99, and tightening screw 112 to lock lever 99 in place. Although the locking means is disclosed as comprising a slot 114 and screw 112, it is to be understood that any means that positively locks lever 99 in position may be used.

Although the embodiments illustrated above involve printing upon pallet-supported articles, it is understood that the article need not be associated with a pallet. A printing belt, e.g. a conveyor belt, may support or carry the article, or the article may be supported by any means consistent with the present invention.

Since from the foregoing the construction and advantage of the invention may be readily understood, further explanation is believed to be unnecessary. However, since numerous modifications will readily occur to those skilled in the art after a consideration of the foreqoinq specification and accompanying drawings, it is not intended that the invention be limited to the exact construction shown and described, but all suitable modifications and equivalents may be resorted to which fall within the scope of the appended claims.

What is claimed is:

1. A printing head assembly for a screen printing machine comprising:

a frame;

a carriage assembly attached to and supported by said frame; and a parallel motion linkage attached to said carriage assembly and adapted to hold a framed screen unit, said parallel motion linkage comprising an adjustement means for the parallel adjustment of the position of the screen unit by a single manipulation, said parallel motion linkage comprising a pair of parallel members for holding the screen unit, said members comprising adjustable means for positioning and locking in the screen unit, said parallel motion linkage further comprising an actuation means for selectably vertically translating said members a fixed distance between a raised position and a lowered position, and wherein said adjustment means is connected to said actuation means and functions to shift the position of said actuation means so that the raised and lowered positions are each vertically shifted the same distance.

2. A printing head assembly according to claim 1, wherein said actuation means comprises a pneumatic actuator cyliner, said cylinder comprising an extendable and retractable member, and wherein said adjustment means comprises a lever pivotally mounted to said cylinder and rotatably mounted to said frame.

3. A printing head assembly according to claim 2 further comprising a locking means associated with said lever, said locking means adapted to hold said lever in a selectable one of a range of rotational positions, and further adapted to be easily released, and then relocked after said lever has been rotated to a new position.

4. A parallel motion linkage, for positioning a screen in a screen printing head assembly, comprising:

a parallel motion means, suspended from a frame of said screen printing head assembly, for holding a framed screen unit above and parallel to an article to be printed upon and for vertically translating said screen between a raised position and a lowered position;

an adjustment means, engaging said parallel motion means, for adjusting the distance between said screen and said article by a single manipulation which effectively shifts the vertical location of said raised and lowered position while keeping said screen level;

said parallel motion means comprising a parallel motion shaft rotatably mounted to said frame, said shaft extending horizontally from one side of said frame to the other side of said frame;

a pair of horizontal parallel operating bars perpendicular to said shaft, said pair of operating bars being linked via crank arms to opposite ends of said shaft;

a pair of flanges for holding said framed screen unit level, each one of said pair of flanges suspended from a different one of said operating bars by a suspension means, said suspension means operating to move said flanges vertically whenever said operating bars move horizontally, said flanges being connected to each other by a cross bar; and an actuation means for driving said operating bars horizontally to cause said flanges to move vertically between said raised and lowered positions, said actuation means being attached to an end of one of said operating bars.

5. A parallel motion linkage according to claim 4, wherein said adjustment means comprises a lever rotatable mounted to said frame and having one end pivotally mounted to said actuation means, said lever operating to shift said actuation means, and thereby said attached operating bars, horizontally to effect a vertical adjustment in the position of said flanges.

6. A parallel motion linkage according to claim 5 wherein said actuation means comprises a pneumatic actuation cylinder, said cylinder comprising an extendable and retractable member.

7. A parallel motion linkage according to claim 6, further comprising a locking means attached to said lever for holding said lever in a selectable one of a range of possible rotational positions, said locking means adapted to be easily released to allow shifting the lever to a new position.

8. A parallel motion linkage according to claim 7 wherein said locking means comprises:

a slot in the frame member attached to said lever; and, a screw having an end which is threaded into said lever and having a screwhead which is disposed on the side of said slot opposite said lever, said screw passing through said slot and adapted to be screwed into said lever to draw said lever and said screwhead tightly against opposite sides of the slotted frame member so that the lever is held in position.

9. A parallel motion linkage according to claim 4, wherein said suspension means comprises bell cranks.

* * * * *